US009970260B2

(12) United States Patent
Gonzalez

(10) Patent No.: US 9,970,260 B2
(45) Date of Patent: May 15, 2018

(54) DUAL SLEEVE STIMULATION TOOL

(71) Applicant: Weatherford Technology Holdings, LLC, Houston, TX (US)

(72) Inventor: Dick Salomon Gonzalez, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 59 days.

(21) Appl. No.: 15/146,053

(22) Filed: May 4, 2016

(65) Prior Publication Data

US 2016/0326836 A1 Nov. 10, 2016

Related U.S. Application Data

(60) Provisional application No. 62/156,757, filed on May 4, 2015.

(51) Int. Cl.
*E21B 34/14* (2006.01)
*E21B 34/10* (2006.01)
(Continued)

(52) U.S. Cl.
CPC ..... *E21B 34/10* (2013.01); *E21B 34/14* (2013.01); *E21B 43/14* (2013.01); *E21B 43/26* (2013.01);
(Continued)

(58) Field of Classification Search
CPC ..... E21B 23/004; E21B 23/006; E21B 2034/007; E21B 34/14
See application file for complete search history.

(56) References Cited

U.S. PATENT DOCUMENTS 4,469,174 A * 9/1984 Freeman ..... E21B 17/14 166/202
6,679,336 B2 1/2004 Musselwhite et al.
(Continued)

FOREIGN PATENT DOCUMENTS

AU 2015252150 A1 5/2016
CN 203603846 U 5/2014
(Continued)

OTHER PUBLICATIONS

Australian Patent Examination Report dated Aug. 23, 2016, for Australian Patent Application No. 2016202840.
(Continued)

*Primary Examiner* — Cathleen R Hutchins
(74) *Attorney, Agent, or Firm* — Patterson & Sheridan, LLP

(57) ABSTRACT

A stimulation tool includes a tubular having a port; a first sleeve member disposed in the tubular and actuatable by an actuating member to move from a closed position wherein fluid communication between a bore of the tubular and the port is blocked; and a closure member disposed in the tubular and actuatable by the actuating member to a closed position wherein fluid communication through the bore of the tubular is blocked. A method of stimulating multiple zones of a tubular in a wellbore includes moving a sleeve member in the tubular by receiving an actuating member in the sleeve member; releasing the actuating member from the sleeve member; and actuating a closure member by receiving the released actuating member in a seat.

20 Claims, 11 Drawing Sheets

(51) Int. Cl.

| | |
|---|---|
| ***E21B 43/14*** | (2006.01) |
| ***E21B 43/26*** | (2006.01) |
| *E21B 34/00* | (2006.01) |
| *E21B 33/12* | (2006.01) |

(52) U.S. Cl.
CPC ..... *E21B 33/12* (2013.01); *E21B 2034/005* (2013.01); *E21B 2034/007* (2013.01)

(56) References Cited

U.S. PATENT DOCUMENTS

| | | | |
|---|---|---|---|
| 7,287,596 | B2 | 10/2007 | Frazier et al. |
| 7,322,417 | B2 | 1/2008 | Rytlewski et al. |
| 7,377,321 | B2 | 5/2008 | Rytlewski |
| 7,387,165 | B2 | 6/2008 | Lopez de Cardenas et al. |
| 7,581,596 | B2 | 9/2009 | Reimert et al. |
| 7,661,478 | B2 | 2/2010 | Palmer et al. |
| 8,261,761 | B2 | 9/2012 | Gerrard et al. |
| 8,272,445 | B2 | 9/2012 | Fay |
| 8,276,674 | B2 | 10/2012 | Lopez de Cardenas et al. |
| 8,403,068 | B2 | 3/2013 | Robison et al. |
| 8,668,013 | B2 | 3/2014 | O'Connell et al. |
| 8,789,600 | B2 | 7/2014 | O'Connell et al. |
| 8,863,853 | B1 | 10/2014 | Harris et al. |
| 2009/0308588 | A1 | 12/2009 | Howell et al. |
| 2010/0282338 | A1 | 11/2010 | Gerrard et al. |
| 2010/0294514 | A1 | 11/2010 | Crow et al. |
| 2010/0294515 | A1 | 11/2010 | Xu |
| 2011/0030976 | A1 | 2/2011 | King |
| 2011/0067888 | A1 | 3/2011 | Mireles |
| 2011/0240301 | A1 | 10/2011 | Robison et al. |
| 2011/0240311 | A1 | 10/2011 | Robison et al. |
| 2011/0278017 | A1 | 11/2011 | Themig et al. |
| 2012/0085548 | A1* | 4/2012 | Fleckenstein ..... E21B 34/063 166/373 |
| 2014/0034294 | A1 | 2/2014 | Hofman et al. |
| 2014/0041876 | A1* | 2/2014 | Fleckenstein ..... E21B 34/08 166/306 |
| 2014/0246207 | A1* | 9/2014 | Hofman ..... E21B 34/14 166/373 |
| 2016/0258259 | A1* | 9/2016 | Walton ..... E21B 34/14 |

FOREIGN PATENT DOCUMENTS

| | | |
|---|---|---|
| CN | 203847089 | 9/2014 |
| WO | 2014020335 A2 | 2/2014 |
| WO | 2014020336 A2 | 2/2014 |
| WO | 2014087153 A2 | 6/2014 |
| WO | 2014140602 A1 | 9/2014 |
| WO | 2014140605 A2 | 9/2014 |
| WO | 2014140609 A2 | 9/2014 |
| WO | 2014140612 A2 | 9/2014 |
| WO | 2014140618 A1 | 9/2014 |

OTHER PUBLICATIONS

Australian Patent Examination Report dated Dec. 22, 2016, for Australian Patent Application No. 2016202840.

EPO Extended European Search Report dated Oct. 13, 2016, for European Patent Application No. 16167792.7.

Australian Patent Examination Report dated May 5, 2017, for Australian Patent Application No. 2016202840.

* cited by examiner

DUAL SLEEVE STIMULATION TOOL

BACKGROUND OF THE INVENTION

Field of the Invention

Embodiments of the present invention relate generally to a stimulation tool. More specifically, the embodiments relate to stimulation tools with a plurality of sleeves capable of being actuated by a single actuating members.

Description of the Related Art

During hydraulic fracturing operations, operators want to minimize the number of trips needed to run in a well and simultaneously optimize the placement of stimulation treatments and rig/fracture equipment. Therefore, operators prefer to use a single-trip, multistage fracing system to selectively stimulate multiple stages, intervals, or zones of the wellbore. Typically, multistage fracing systems have a series of packers along a tubing string to isolate zones in the well. Interspersed between the packers along the tubing string are ports and isolation tools with sliding sleeves capable of allowing fluid communication through the ports. The sliding sleeves are initially closed, but can be opened to stimulate the various zones along the tubing string.

Traditionally, operators rig up fracturing surface equipment and apply pressure to open a sliding sleeve on an end of the tubing string. Then, a first zone is treated. Each remaining unopened sliding sleeve in the isolation tools further uphole is subsequently actuated such that fluid is diverted to flow out of the tubing string and to fracture the zones along the tubing string. The actuation of the sliding sleeves must be performed in a sequential manner to allow the borehole to be progressively fractured along the length of the bore, without leaking fracture fluid out through previously fractured regions.

Due to the expense and frequent failure of electrical devices downhole, the most common approach to actuate the sliding sleeves is mechanical. For example, successive zones are treated by dropping successively increasing sized balls down the tubing string. Each ball opens a corresponding sleeve such that each individual zone can be accurately stimulated.

The sliding sleeves are configured such that the first dropped ball, which has the smallest diameter relative to the other balls, passes through at least one sliding sleeve having a ball seat larger than the first ball. The first ball continues down the tubing string until the first ball reaches the sliding sleeve furthest downhole. The sliding sleeve furthest downhole is configured to have a ball seat smaller than the first dropped ball such that the first ball seats at the sliding sleeve to block a bore of the tubing string and cause a port to open. As a result, the first ball in the sliding sleeve diverts fluid flow into the formation adjacent the port.

Subsequently, balls of increasing size are dropped into the tubing string such that the balls pass through the nearest sliding sleeves but seat at a sliding sleeve further downhole having a suitably sized seat. As is typical, the dropped balls engage respective seat sizes in the sliding sleeves and create barriers to the zones below. Applied differential tubing pressure then moves the sliding sleeve to expose the port such that treatment fluid may stimulate the zone adjacent the port. This process may be repeated until all of the sliding sleeves have been actuated in the order of furthest downhole to nearest the surface.

Although dropping balls of increasing size to actuate sliding sleeves remains a common technique for stimulation, this approach has a number of disadvantages. First, practical limitations restrict the number of zones that can be stimulated in the tubing string. For example, because the zones are treated in stages, the smallest ball and corresponding ball seat are used for the sliding sleeve furthest downhole. Sliding sleeves nearer to the surface have successively larger seats for larger balls. As a result, the number of sliding sleeves that may be used is limited by the dimensions of the tubing string and ball seat sizes.

Another disadvantage of conventional stimulation techniques is that the ball seats act as undesirable restrictions to fluid flow through the tubing string. For example, small ball seats yield large fluid flow restrictions. As a result, when stimulating zones, fluid flow restrictions in the tubing string will yield an inefficient production rate.

Therefore, there is a need for a more efficient system and method for isolating multiple zones of the wellbore.

SUMMARY OF THE INVENTION

A stimulation tool includes a tubular having a port; a first sleeve member disposed in the tubular and actuatable by an actuating member to move from a closed position wherein fluid communication between a bore of the tubular and the port is blocked; and a closure member disposed in the tubular and actuatable by the actuating member to a closed position wherein fluid communication through the bore of the tubular is blocked.

A multi-zone stimulation assembly includes a tubular a tubular having a first port, a second port, and a bore therethrough; a first sleeve member having a first seat, the first sleeve member configured to selectively allow fluid communication through the first port; a third sleeve member having a third seat; and a closure member disposed between the first and second ports and actuatable by the third sleeve member to a closed position wherein fluid communication is blocked through the bore of the tubular.

A method of stimulating multiple zones of a tubular in a wellbore includes moving a sleeve member in the tubular by receiving an actuating member in the sleeve member; releasing the actuating member from the sleeve member; and actuating a closure member by receiving the released actuating member in a seat.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a longitudinal axis of a wellbore, and "below", "lower", "downward" and similar terms refer to a direction away from the earth's surface along the longitudinal axis of the wellbore.

The present invention is directed to a method and apparatus for stimulating multiple zones in a wellbore with a plurality of sleeves capable of being actuated by a single actuating member.

Figure 1:
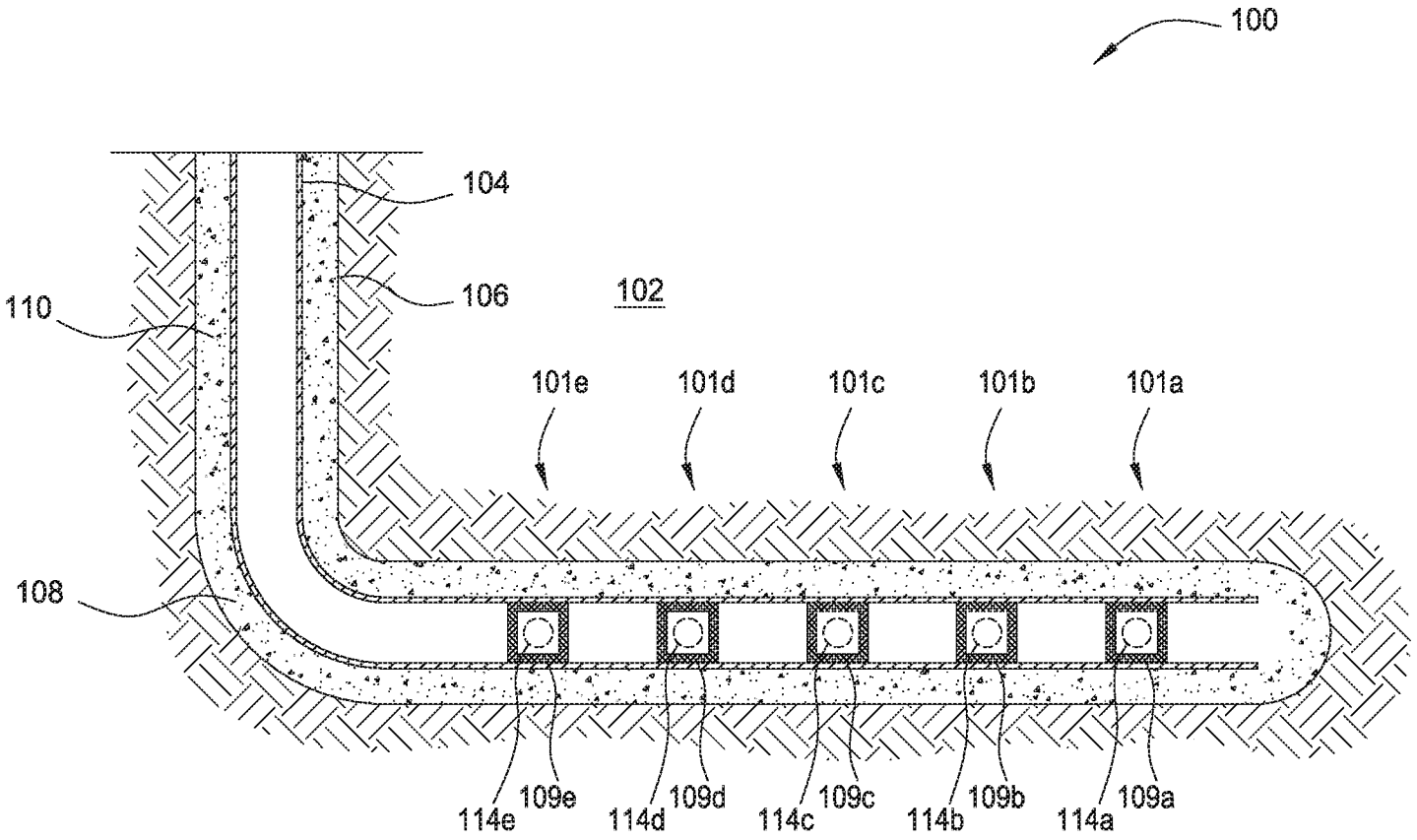
FIG. 1 illustrates an embodiment of a system for selectively isolating a plurality of zones in a wellbore.

FIG. 1 illustrates an embodiment of a stimulation system 100 for selectively isolating and/or stimulating a plurality of zones 101*a-e* of a wellbore 106 in a formation 102. The zones 101*a-e* are spaced axially along the wellbore 106. For example, the zones 101*a-e* may correspond to areas in the formation 102 with a potential for yielding production fluid. The stimulation system 100 includes a tubular 104 lowered into the wellbore 106, thereby creating an annulus 108 in the space therebetween. As used herein, the tubular 104 or 203 is used to indicate any type of tubular, mandrel, string, and/or sub strings, and such used alone or in combination to transport fluid to and from the wellbore 106. The annulus 108 may be sealed using cement 110 or another suitable, hardenable substance in order to reduce or prevent fluid communication between the zones 101*a-e* via the annulus 108. Alternatively, the annulus 108 may be sealed using packers or other sealing materials.

The stimulation system 100 includes an isolation tool 109 and a port 114 in each zone 101*a-e*. For example, a plurality of isolation tools 109*a-e* and ports 114*a-e* are spaced axially along the tubular 104. While FIG. 1 illustrates five isolation tools 109 in the stimulation system 100, any appropriate number of isolation tools 109, and as many ports 114, may be used in conjunction with the system and method of the present disclosure. For example, two or more isolation tools may be positioned in a single zone, or one isolation tool may serve two or more zones.

The isolation tools 109 in the stimulation system 100 are used to control the placement of an injected fluid. In one embodiment, the isolation tools 109 are used in a cementing operation to inject cement 110 into the annulus 108. In another embodiment, the isolation tools 109 are used in a stimulation operation to inject stimulation or frac fluid into the formation 102. In yet another embodiment, the isolation tools 109 are used to inject any suitable fluid into the formation 102, such as water, gas, or steam.

Figure 2:
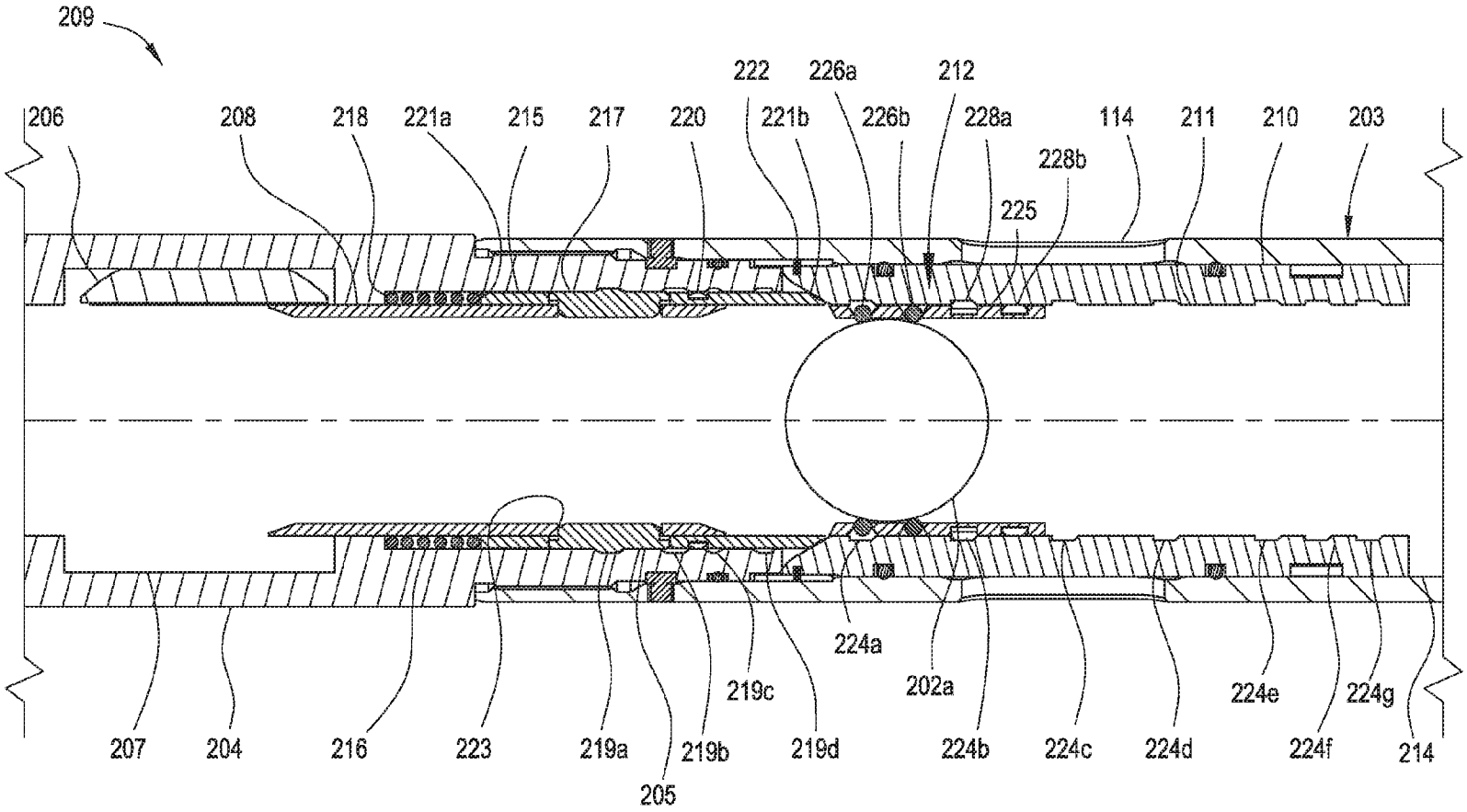
FIG. 2 is a cross sectional view of an exemplary isolation tool with a closure member in an open position, a sliding sleeve member in a closed position, a counting mechanism in a first position, and an actuating member engaged with the counting mechanism.

FIG. 2 is a cross sectional view of an exemplary embodiment of an isolation tool 209. The isolation tool 209 is shown with an actuating member 202, such as a ball 202*a*, disposed therein. The isolation tool 209 includes a tubular 203, a closure member 206, a first sleeve member 208, and a second sleeve member 210.

The tubular 203 includes the port 114, a mandrel 204, and a bore 214 extending through the tubular 203. The mandrel 204 includes a recess 207 and a plurality of grooves 219*a-d* on an inner surface 205. The closure member 206, such as a flapper valve 206, is disposed in the recess 207 of the mandrel 204 while the flapper valve 206 is in an open position. In the open position, the flapper valve 206 permits fluid communication through the bore 214 of the tubular 203. The flapper valve 206 may include a biasing member, such as a spring, which biases the flapper valve 206 towards a closed position, wherein the flapper valve 206 blocks fluid communication through the bore 214 of the tubular 203. In one embodiment, the spring is a torsion spring located at a hinge of the flapper valve 206. Although a flapper valve is described herein, any suitable valve may be used in the isolation tool 209 without departing from the scope of the invention.

The first sleeve member 208 and the second sleeve member 210 are disposed in the bore 214 of the tubular 203. In one embodiment, the first sleeve member 208, such as upper sliding sleeve 208, and an engagement sleeve 215 having a first end 221*a* and a second end 221*b* are integrally formed. In another embodiment, the upper sliding sleeve 208 is operatively coupled to the engagement sleeve 215. For example, the engagement sleeve 215 includes at least one engagement member 217, such as a dog 217. Each dog 217 protrudes through a corresponding slot 223 in the upper sliding sleeve 208, thereby operatively connecting the upper sliding sleeve 208 and the engagement sleeve 215. As such, movement of the engagement sleeve 215 in the axial direction moves the upper sliding sleeve 208 in the same direction. The dogs 217 interact with the inner surface 205 to control movement of the upper sliding sleeve 208. For example, the dogs 217 extend through the slots 223 in the upper sliding sleeve 208 and slide along the inner surface 205. The dogs 217 are biased radially outwards from a center of the bore 214. In one embodiment, the dogs 217 are spring-loaded and biased against the inner surface 205. As such, when the dogs 217 are axially aligned with the grooves 219*a*, 219*b*, the dogs 217 sequentially extend into the grooves 219*a*, 219*b* and avoid obstructing the bore 214. Initially, the dogs 217 extend into groove 219*a*, as shown in FIG. 2. When the engagement sleeve 215 moves downwards, the dogs 217 move downwards. The dogs 217 moves out of the groove 219*a* and onto the inner surface 205 of the mandrel 204, thereby moving radially towards the center of the bore 214. As a result, the dogs 217 partially obstruct the bore 214 and form a seat for receiving the actuating member 202. The engagement sleeve 215 also includes at least one locking member, each of which is biased radially outwards from the center of the bore 214. In one embodiment, the locking member is a dog biased radially outward by a biasing member, such as a spring. In another embodiment, the locking member is a snap ring biased radially outward. In yet another embodiment, the locking member is a lock ring 220 biased radially outward. The lock ring 220 moves between a retracted position, wherein the lock ring 220 is disposed in a groove formed in the engagement sleeve 215, and an extended position, wherein the lock ring 220 extends into the grooves 219*c*, 219*d* of the mandrel 204. Initially, the lock ring 220 is in the retracted position, as shown in FIG.

2. In the retracted position, the lock ring 220 engages the inner surface 205 of the mandrel 204. When the engagement sleeve 215 moves downwards, the lock ring 220 moves downwards and extends into the groove 219*c*. By extending into the groove 219*c*, the lock ring 220 resists downward movement of the engagement sleeve 215 up to a threshold force in the downward direction. For example, the lock ring 220 is biased into the grooves 219*c*, 219*d* such that the lock ring 220 retracts when the ball 202*a* indirectly exerts a downward force on the engagement sleeve 215 via the dogs 217 equal to or greater than the threshold force of the lock ring 220. When the engagement sleeve 215 moves further downwards, the lock ring 220 retracts and subsequently extends into the groove 219*d*.

Figure 8:
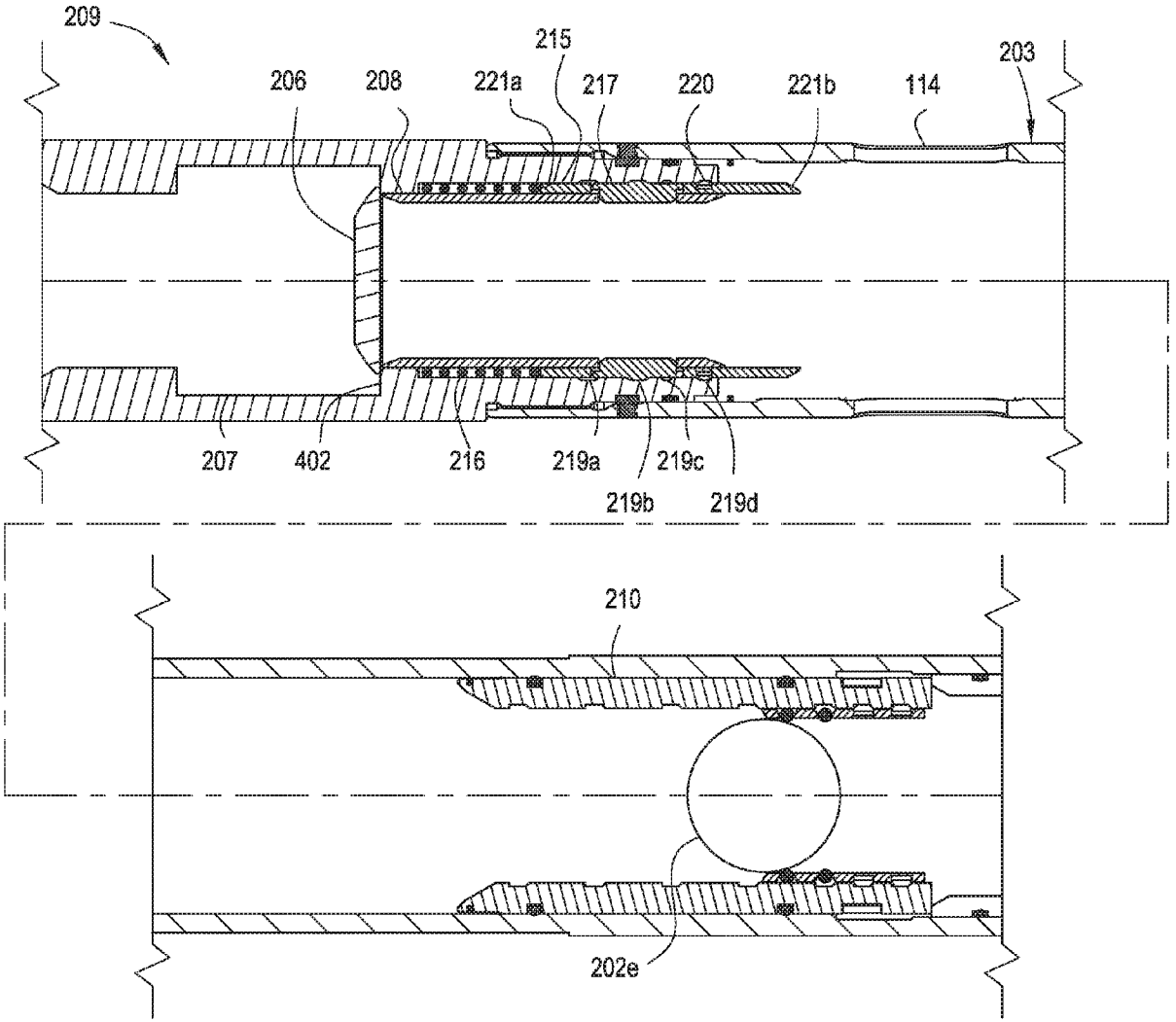
FIG. 8 is a cross sectional view of the isolation tool of FIG. 2 with the closure member in a closed position, a sliding sleeve member in the open position, and a ball engaged with sliding sleeve member.

In one embodiment, the upper sliding sleeve 208 restricts movement of the flapper valve 206 from the open position (FIG. 2) to the closed position (FIG. 8). For example, the upper sliding sleeve 208 at least partially covers the flapper valve 206 such that the flapper valve 206 cannot rotate at the hinge. The upper sliding sleeve 208 is biased away from the flapper valve 206 by a biasing member 216. The biasing member 216, such as a spring 216, is disposed between a shoulder 218 of the mandrel 204 and the first end 221*a* of the engagement sleeve 215. As such, the spring 216 is configured to bias the engagement sleeve 215 and the upper sliding sleeve 208 downwards. Downward movement of the engagement sleeve 215 is restricted by the second sleeve member 210, such as a lower sliding sleeve 210.

Figure 7:
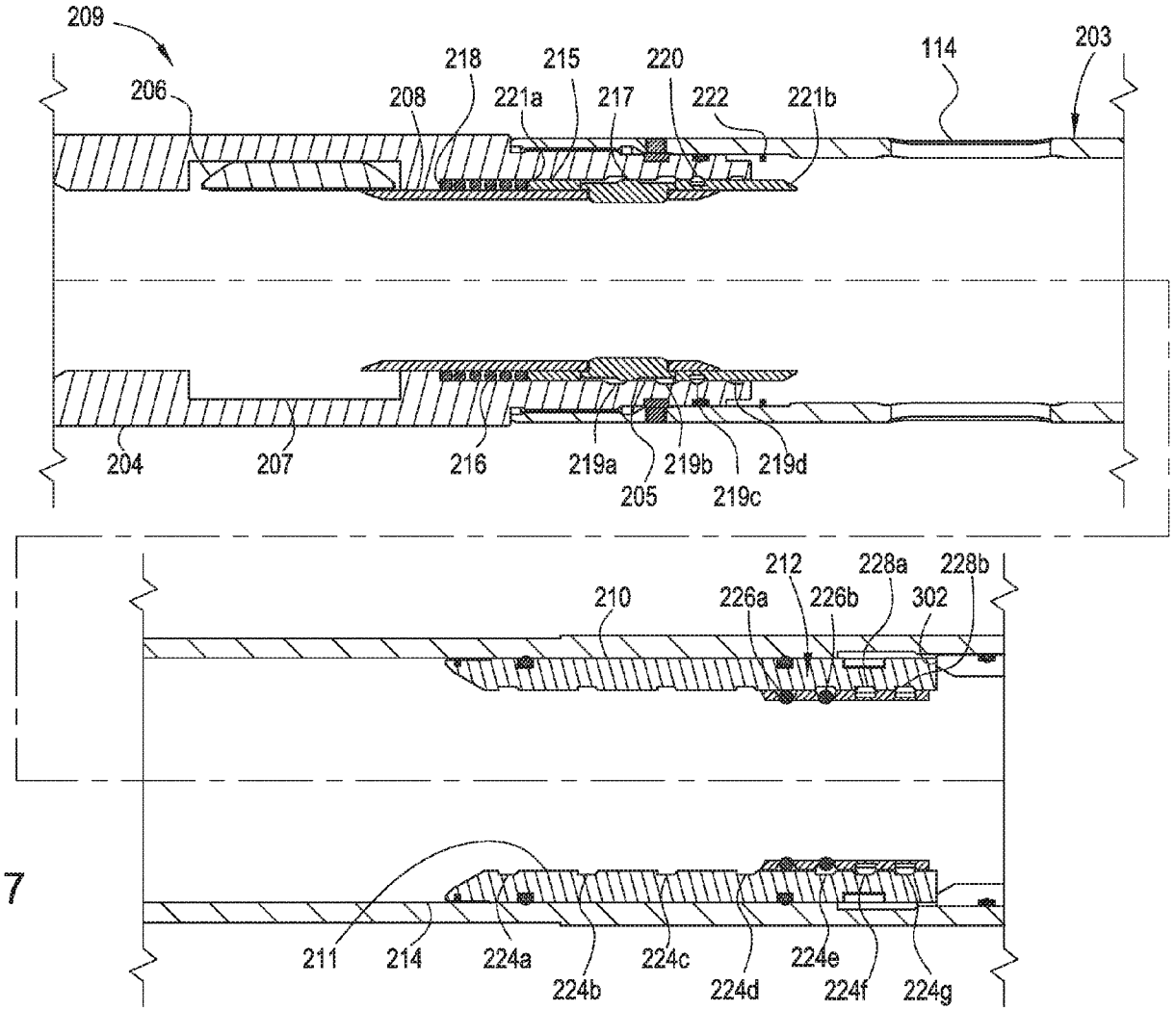
FIG. 7 is a cross sectional view of the isolation tool of FIG. 2 with the closure member in the open position and the sliding sleeve member in an open position.

The lower sliding sleeve 210 is movable from a closed position (FIG. 2) to an open position (FIG. 7). In the closed position, the second end 221*b* of the engagement sleeve 215 abuts the lower sliding sleeve 210. The lower sliding sleeve 210 is configured so that a downward force provided by the spring 216 is insufficient to move the engagement sleeve 215 and the lower sliding sleeve 210 downwards. For example, a frangible member 222, such as a shear ring 222, may hold the lower sliding sleeve 210 in the closed position and prevent the lower sliding sleeve 210 from moving downwards. The shear ring 222 shears at a threshold force in the downward direction. The downward force of the spring 216 is set to less than the threshold force of the shear ring 222 to prevent premature movement of the lower sliding sleeve 210 from the closed position. In the closed position, the lower sliding sleeve 210 reduces or blocks fluid communication between the bore 214 of the tubular 203 and the port 114. For example, the lower sliding sleeve 210 covers the port 114 such that fluid communication between the bore 214 and the port 114 is blocked.

The lower sliding sleeve 210 includes a counting mechanism 212 and a plurality of grooves 224*a-g* spaced axially along an inner surface 211 of the lower sliding sleeve 210, as shown in FIG. 2. The counting mechanism 212 counts the number of actuating members 202 passing through the bore 214 of the isolation tool 209 during a counting operation. The counting operation includes a plurality of counts. A count begins when the counting mechanism 212 receives the actuating member 202 in a seat formed by the counting mechanism 212. The actuating member 202 moves the counting mechanism 212 relative to the lower sliding sleeve 210 until the actuating member is no longer seated in the counting mechanism 212. Thereafter, the counting mechanism 212 releases the actuating member 202 and the counting mechanism 212 stops moving relative to the lower sliding sleeve 210. The count ends when the counting mechanism 212 releases the actuating member. During the counting operation, the counting mechanism 212 may perform any suitable number of counts using a corresponding number of actuating members 202. After the counting operation is completed, the next actuating member 202 sent downhole causes the movement of the lower sliding sleeve 210 from the closed position towards the open position. In one embodiment, each actuating member 202 is the same size. For example, each ball 202 has the same diameter.

In one embodiment, the counting mechanism 212 includes a counter sleeve 225 with a plurality of alternating engagement members, such as upper and lower ball bearings 226*a*, 226*b* arranged circumferentially about the counter sleeve 225. In another embodiment, the engagement members are dogs biased radially outward by a biasing member, such as a spring. The counting mechanism 212 also includes a plurality of alternating locking members, such as upper and lower snap rings 228*a*, 228*b*. In one embodiment, the locking members are lock rings. The grooves 224*a-g* are circumferentially arranged on an inner surface of the lower sliding sleeve 210. The grooves 224*a-g* are configured to receive the engagement members and locking members of the counting mechanism 212. In one embodiment, the ball bearings 226*a*, 226*b* are free-floating between the counter sleeve 225 and the lower sliding sleeve 210. The snap rings 228*a*, 228*b* may be biased radially outwards from the center of the bore 214.

Figure 3:
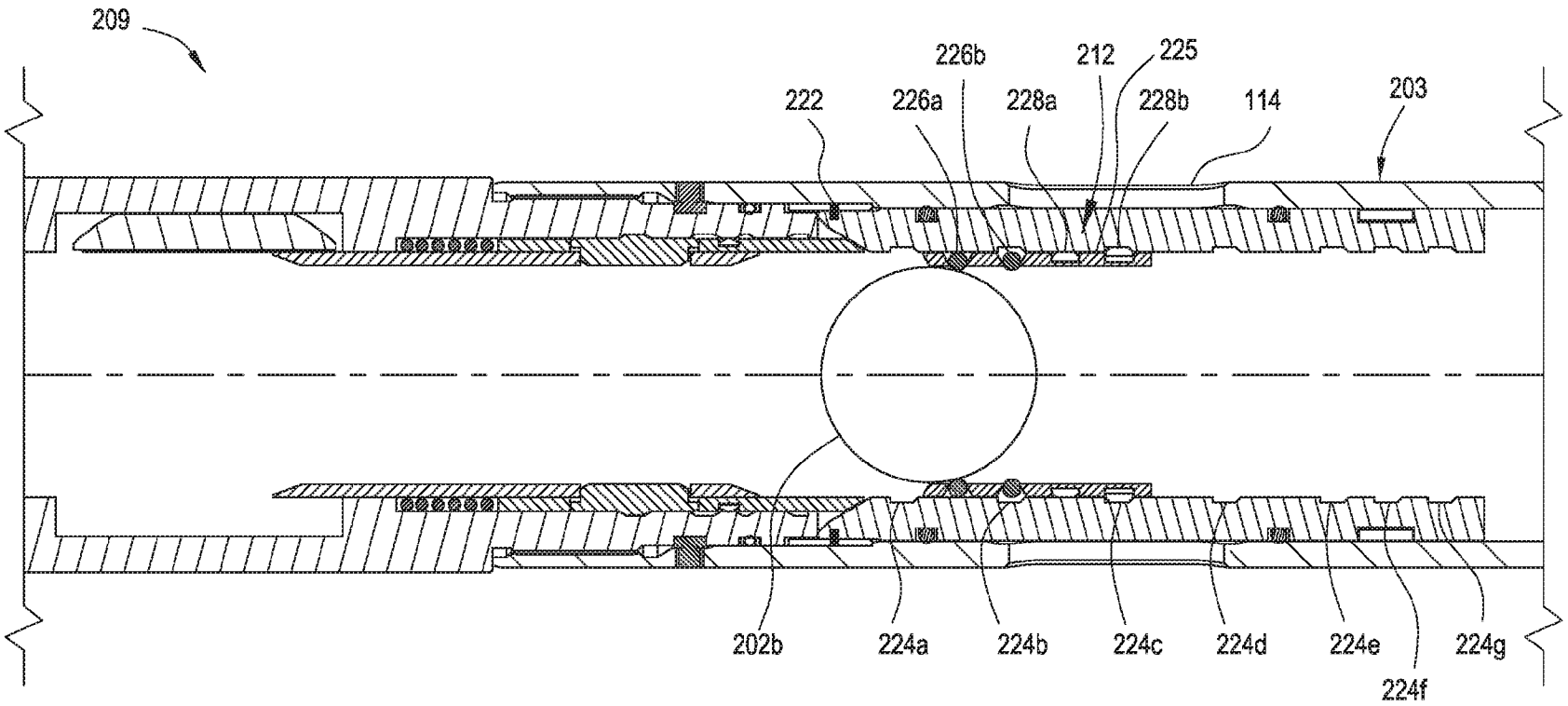
FIG. 3 is a cross sectional view of the counting mechanism of FIG. 2 in a second position.

The snap rings 228*a*, 228*b* control the downward advancement of the counter sleeve 225. In one embodiment, the snap rings 228*a*, 228*b* each include ramped lead edges to facilitate advancement out of the grooves 224*a-g*. The snap rings 228*a*, 228*b* alternatingly move between an extended position and a retracted position. In the retracted position, the snap rings 228*a*, 228*b* are disposed in respective grooves formed in the counter sleeve 225 and engage the inner surface 211. In the extended position, the snap rings 228*a*, 228*b* move into respective grooves 224*a-g* in the lower sliding sleeve 210. In the extended position, the snap rings 228*a*, 228*b* resist downward movement of the counter sleeve 225 relative to the lower sliding sleeve 210 up to a threshold force. Initially, the upper snap ring 228*a* is in the extended position at groove 224*b* and the lower snap ring 228*b* is in the retracted position, as shown in FIG. 2. The upper snap ring 228*a* resists downward movement of the counter sleeve 225 up to the threshold force of the upper snap ring 228*a*. When the counter sleeve 225 experiences a downward force equal to or greater than the threshold force of the upper snap ring 228*a*, the upper snap ring 228*a* retracts and the counter sleeve 225 moves downwards. The lower snap ring 228*b* subsequently moves into the extended position at groove 224*c* and the upper snap ring 228*a* moves into the retracted position, as shown in FIG. 3. Thereafter, the lower snap ring 228*b* resists downward movement of the counter sleeve 225 up to the threshold force of the lower snap ring 228*b*.

In one embodiment, sequentially moving the counter sleeve 225 axially downwards in the tubular 203 sequentially moves the ball bearings 226*a*, 226*b* and the snap rings 228*a*, 228*b* into and out of the grooves 224*a-g*. The ball bearings 226*a*, 226*b* are configured to form alternating seats when the counter sleeve 225 moves downwards. The upper ball bearings 226*a* can move into the groove 224*a* while the lower ball bearings 226*b* move onto the inner surface 211, as shown in FIG. 2. By engaging the inner surface 211, the lower ball bearings 226*b* are forced radially inwards to partially obstruct the bore 214. As a result, the lower ball bearings 226*b* form a seat for the ball 202*a*. When the counter sleeve 225 moves downwards, the upper and lower ball bearings 226*a*, 226*b* move downwards. In turn, the upper ball bearings 226*a* move onto the inner surface 211 and the lower ball bearings 226*b* move into the groove 224*b*, as shown in FIG. 3. By engaging the inner surface 211, the upper ball bearings 226*a* are forced radially inwards to partially obstruct the bore 214. As a result, the upper ball bearings 226*a* form a seat.

Although the lower sliding sleeve 210 is described as including the counting mechanism 212, the upper sliding sleeve 210 may also incorporate the counting mechanism 212 as an alternative to the engagement sleeve 215 and its corresponding features. Although the isolation tool 209 shows a single upper sliding sleeve 208, lower sliding sleeve 210, counting mechanism 212, flapper valve 206, and port 114, it is contemplated that any appropriate number of upper sliding sleeves, lower sliding sleeves, counting mechanisms, flapper valves, ports, and corresponding features may be used in the isolation tool 209 without departing from the scope of the invention.

The counting operation begins by releasing the ball 202*a* into the tubular 104. The ball 202*a* moves downwards in the tubular 104 until the ball 202*a* engages the counting mechanism 212. In one embodiment, the ball 202*a* engages the counting mechanism 212 by landing on a seat formed by the lower ball bearings 226*b*, as shown in FIG. 2. This begins a first count. Thereafter, the ball 202*a* moves the counter sleeve 225 downwards. In one example, a downward force produced by the momentum of the ball 202*a* plus a fluid force behind the ball 202*a* is equal to or greater than the threshold force of the upper snap ring 228*a*. In turn, the ball 202*a* causes the upper snap ring 228*a* to retract, which allows the counter sleeve 225 to move downwards. In another example, the fluid force behind the ball 202*a* is increased after the ball 202*a* lands in the counting mechanism 212 in order to produce a downward force equal to or greater than the threshold force of the upper snap ring 228*a*. In one embodiment, the threshold force of the upper snap ring 228*a* is set lower than the threshold force of the shear ring 222. As such, the ball 202*a* causes the upper snap ring 228*a* to retract without causing the shear ring 222 to shear.

The counter sleeve 225 travels downwards until the lower snap ring 228*b* extends into the groove 224*c*, as shown in FIG. 3. The lower ball bearings 226*b* move into the groove 224*b* and the upper ball bearings 226*a* move onto the inner surface 211 of the lower sliding sleeve 210. As such, the upper ball bearings 226*a* form a seat for a next ball 202*b*. The lower ball bearings 226*b*, which served as the seat for the ball 202*a*, no longer form the seat. As a result, the ball 202*a* is released from the counting mechanism 212. This completes the first count. Thereafter, the ball 202*a* is allowed to move downwards out of the isolation tool 209 and engage other tools downhole.

Figure 4:
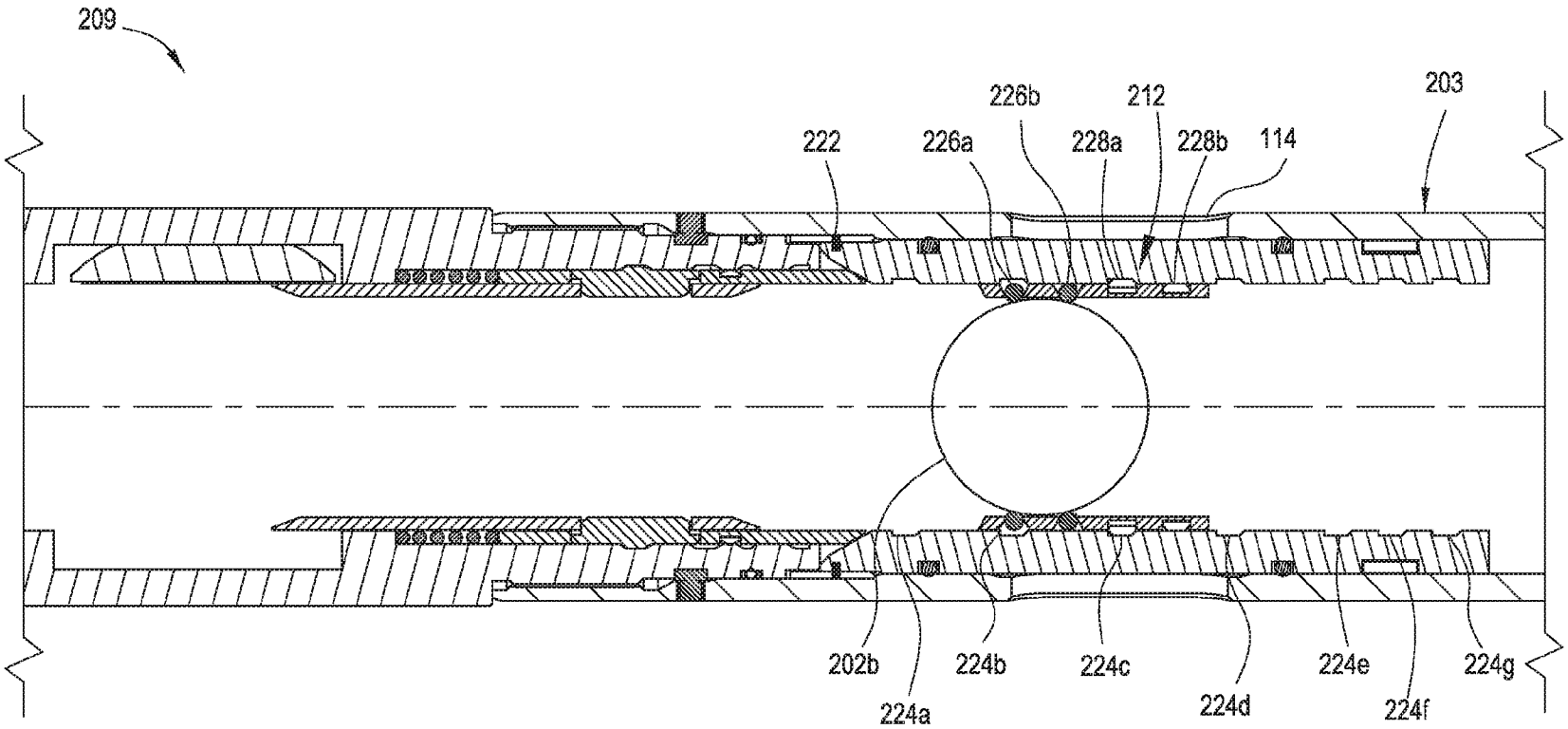
FIG. 4 is a cross sectional view of the counting mechanism of FIG. 2 in a third position.

Next, the ball 202*b* is released into the tubular 104. The ball 202*b* moves downwards in the tubular 104 and engages the counting mechanism 212. In one embodiment, the ball 202*b* engages the counting mechanism 212 by landing on the seat formed by the upper ball bearings 226*a*, as shown in FIG. 3. This begins a first half of the second count. Thereafter, the ball 202*b* moves the counter sleeve 225 downwards. For example, a downward force produced by the momentum of the ball 202*b* plus a fluid force behind the ball 202*b* is equal to or greater than the threshold force of the lower snap ring 228*b*. In turn, the ball 202*b* causes the lower snap ring 228*b* to retract, which allows the counter sleeve 225 to move downwards. In another example, the fluid force behind the ball 202*b* is increased after the ball 202*b* lands in the counting mechanism 212 in order to produce a downward force equal to or greater than the threshold force of the lower snap ring 228*b*. In one embodiment, the threshold force of the lower snap ring 228*b* is set lower than the threshold force of the shear ring 222. As such, the ball 202*b* causes the lower snap ring 228*b* to retract without causing the shear ring 222 to shear. The counter sleeve 225 moves downwards until the upper snap ring 228*a* moves into the groove 224*c*, as shown in FIG. 4. The upper ball bearings 226*a*, which initially served as the seat for the ball 202*b* during the first half of the second count, move into the groove 224*b* and no longer form the seat. In turn, the ball 202*b* is released from the upper ball bearings 226*a*. This completes the first half of a second count.

Figure 5:
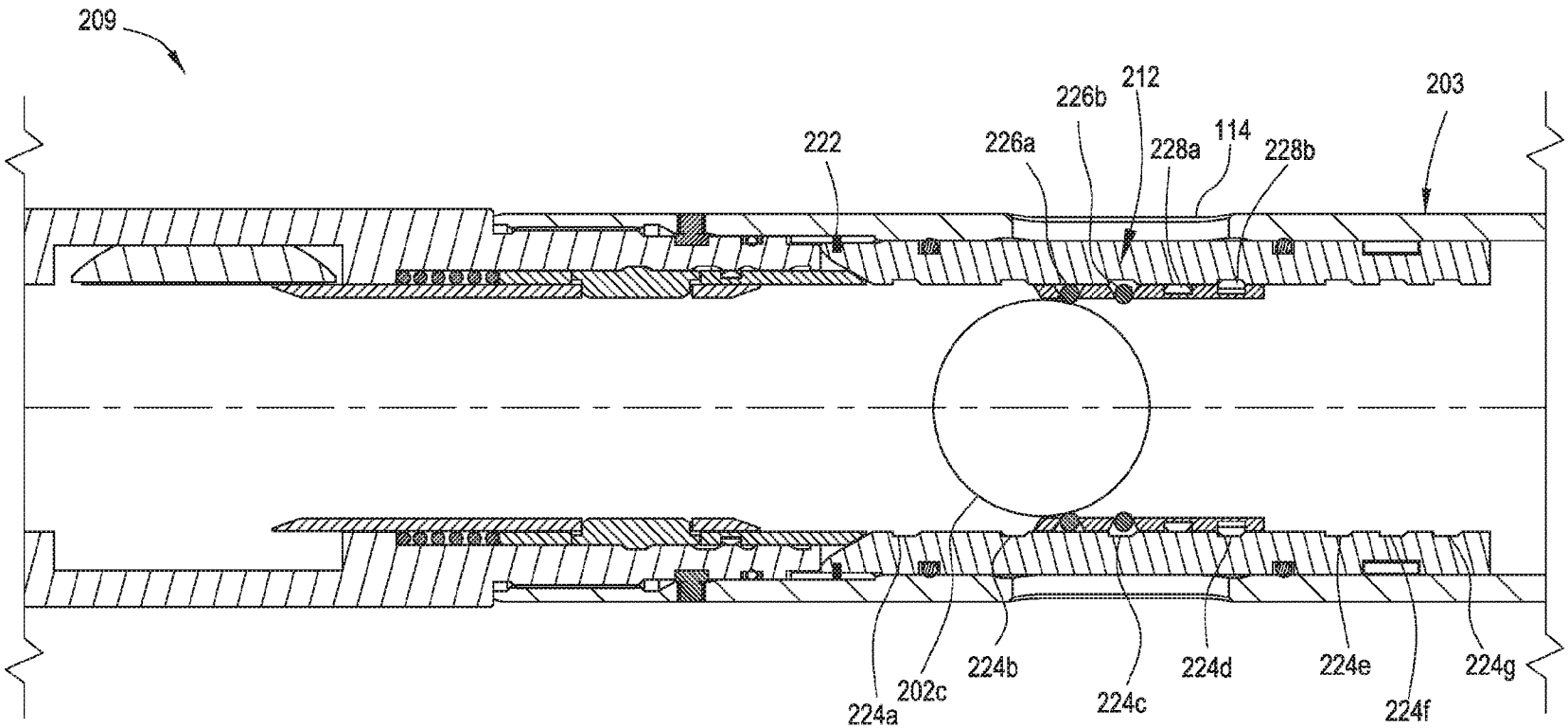
FIG. 5 is a cross sectional view of the counting mechanism of FIG. 2 in a fourth position.

After the ball 202*b* is released from the upper ball bearings 226*a*, the ball 202*b* lands in a seat formed by the lower ball bearings 226*b*, as shown in FIG. 4. This begins a second half of the second count. The ball 202*b* continues to move the counter sleeve 225 downwards relative to the lower sliding sleeve 210 by causing the retraction of the upper snap ring 228*a*. For example, the downward force produced by the momentum of the ball 202*b* plus the fluid force behind the ball 202*b* is equal to or greater than the threshold force of the upper snap ring 228*a*. In turn, the ball 202*b* causes the upper snap ring 228*a* to retract, which allows the counter sleeve 225 to continue moving downwards. In another example, the fluid force behind the ball 202*b* is increased after the ball 202*b* lands in the counting mechanism 212 in order to produce a downward force equal to or greater than the threshold force of the upper snap ring 228*a*. The counter sleeve 225 travels downwards until the lower snap ring 228*b* extends into the groove 224*d*, as shown in FIG. 5. The lower ball bearings 226*b* move into the groove 224*c* and the upper ball bearings 226*a* move onto the inner surface 211 of the lower sliding sleeve 210. As such, the upper ball bearings 226*a* form a seat for a next ball 202*c*. The lower ball bearings 226*b*, which served as the seat for the ball 202*b*, no longer form the seat. As a result, the ball 202*b* is released from the counting mechanism 212. This completes the second half of the second count. Thereafter, the ball 202*b* is allowed to move downwards out of the isolation tool 209 and engage other tools downhole.

Next, the ball 202*c* is released into the tubular 104. The counting mechanism 212 subsequently receives the ball 202*c* in the seat formed by the upper ball bearings 226*a*, as shown in FIG. 5. This begins a first half of a third count. The ball 202*c* moves the counter sleeve 225 downwards by first seating on the upper ball bearings 226*a* and then seating on the lower ball bearings 226*b*, similar to the second count using the ball 202*b*. The counter sleeve 225 moves downwards until lower snap ring 228*b* extends into the groove 224*e*. After moving the counter sleeve 225, the lower ball bearings 226*b* move into the groove 224*d* and release the ball 202*c*. This completes the third count. At the end of the third count, the upper ball bearings 226*a* move onto the inner surface 211 and form a seat for a next ball 202*d*. In this embodiment, the third count represents a final count of the counting operation. The counting operation is completed when the final count is completed. After the final count, the counting mechanism 212 is in an actuating position. In other words, the next ball 202 to land in the counting mechanism 212 will actuate the lower sliding sleeve 210 into the open position.

The lower sliding sleeve 210 may include any appropriate number of grooves in order to lengthen or shorten the counting operation. The counting operation may be lengthened or shortened by selecting a starting position of the counter sleeve 225 on the lower sliding sleeve 210. In one embodiment, the number of balls 202 counted by the counting mechanism 212 is increased by increasing the number of grooves 224 in the counter sleeve 225 and/or by positioning the counter sleeve 225 towards an upper end of the lower sliding sleeve 210.

Figure 6:
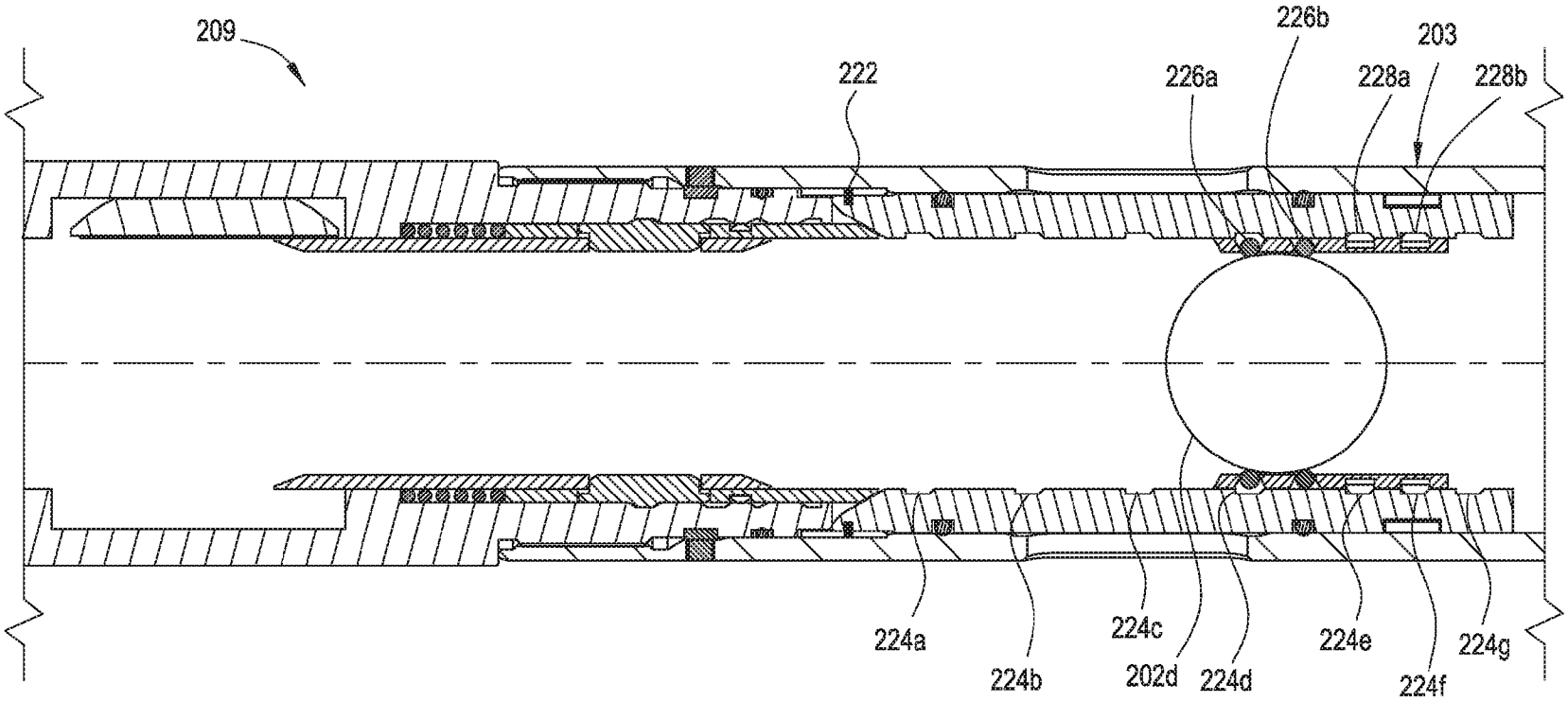
FIG. 6 is a cross sectional view of the counting mechanism of FIG. 2 in a fifth position.

Next, the ball 202*d* is released into the tubular 104. The ball 202*d* is released into the tubular 104 to actuate the lower sliding sleeve 210 from the closed position to the open position. The ball 202*d* lands in the seat formed by the upper ball bearings 226*a*. Similar to the preceding balls 202*a-c*, the downward force of the ball 202*d* causes the lower snap ring 228*b* to retract, thereby allowing the counter sleeve 225 to move downwards. The counter sleeve 225 moves downwards until the upper and lower snap rings 228*a*, 228*b* extend into respective grooves 224*e*, 224*f*, as shown in FIG. 6. The upper ball bearings 226*a* move into the groove 224*d*, thereby releasing the ball 202*d*. The ball 202*d* lands in a seat formed by the lower ball bearings 226*b*. When both the upper and lower snap rings 228*a*, 228*b* are in respective grooves 224*e*, 224*f*, a force equal to or greater than the combined threshold force of the upper and lower snap rings 228*a*, 228*b* is required to move the counter sleeve 225. In one embodiment, the combined threshold force of the upper and lower snap rings 228*a*, 228*b* is set to be equal to or greater than the threshold force required to shear the shear ring 222.

The ball 202*d* continues urge the counter sleeve 225 downwards by exerting a downward force on the seat formed by the lower ball bearings 226*b*. In one embodiment, the downward force produced by the momentum of the ball 202*d* plus a fluid force behind the ball 202*d* is equal to or greater than the combined threshold force of the upper and lower snap rings 228*a*, 228*b*. In another embodiment, the fluid force behind the ball 202*d* is increased after the ball 202*d* lands in the counting mechanism 212 in order to produce a downward force equal to or greater than the combined threshold force of the upper and lower snap rings 228*a*, 228*b*. In turn, the ball 202*d* causes both the upper and lower snap rings 228*a*, 228*b* to retract, which allows the counter sleeve 225 to move downwards. Because the combined threshold force of the upper and lower snap rings 228*a*, 228*b* is equal to or greater than the threshold force of the shear ring 222, the downward force of the ball 202*d* also causes the shear ring 222 to shear. As a result, the lower sliding sleeve 210 is allowed to move towards the open position, as shown in FIG. 7. For example, the lower sliding sleeve 210 moves towards the open position by sliding downward.

The counter sleeve 225 moves downwards relative to the lower sliding sleeve 210 until the upper and lower snap rings 228*a*, 228*b* extend into respective grooves 224*f*, 224*g*, as shown in FIG. 7. The upper ball bearings 226*a* move onto the inner surface 211 and form a seat for a next ball 202*e*. The lower ball bearings 226*b* move into the groove 224*e*, thereby releasing the ball 202*d* from the counting mechanism 212. Thereafter, the ball 202*d* is allowed to act on other tools downhole.

In the open position, the lower sliding sleeve 210 allows fluid communication between the bore 214 and the port 114. In one embodiment, the lower sliding sleeve 210 abuts a shoulder 302 in the tubular 203 when the lower sliding sleeve 210 is in the open position. The shoulder 302 prevents further downward movement of the lower sliding sleeve 210.

Movement of the lower sliding sleeve 210 from the closed position to the open position disengages the second end 221*b* of the engagement sleeve 215 from the lower sliding sleeve 210. In turn, the engagement sleeve 215 is allowed to move a distance downward. In one embodiment, the spring 216 exerts a force against the first end 221*a* of the engagement sleeve 215 to move the engagement sleeve 215 downward. In turn, both the dogs 217 and the lock ring 220 on the engagement sleeve 215 also move downward. The lock ring 220 stops the downward movement of the engagement sleeve 215 by extending into the groove 219*c*, as shown in FIG. 7. The lock ring 220 resists further downward movement of the engagement sleeve 215 up to the threshold force of the lock ring 220. By moving the engagement sleeve 215 downward, the dogs 217 move onto the inner surface 205 of the mandrel 204 and form a seat configured to receive a subsequent actuating member, such as the ball 202*e*.

The flapper valve 206 remains in the open position after the lower sliding sleeve 210 moves to the open position, as shown in FIG. 7. In one embodiment, the lock ring 220 limits the downward movement of the engagement sleeve 215 such that the upper sliding sleeve 208 at least partially covers the flapper valve 206. Consequently, the flapper valve 206 cannot move into the closed position by rotating around the hinge. With the flapper valve 206 in the open position and the lower sliding sleeve 210 in the open position, an injection operation may be performed through the port 114. For example, the injection operation may include injecting fluid such as water, gas, steam, stimulation or frac fluid into the formation 102 via the port 114.

After the injection operation through the port 114 has concluded, the flapper 206 is moved to the closed position such that injection operations may be conducted in isolation tools further uphole. The ball 202*e* may be released into the tubular 104 to actuate the flapper valve 206 into the closed position. When the ball 202*e* arrives in the isolation tool 209, it lands in the seat formed by the dogs 217. The ball 202*e* moves the dogs 217 downward until the dogs 217 extend into the groove 219*b*, thereby releasing the ball 202*e* from the upper sliding sleeve 208. The ball 202*e* causes the lock ring 220 to move into the groove 219*d* and thus prevent further downward movement of the engagement sleeve 215. By moving the dogs 217 downwards, the ball 202*e* also moves the engagement sleeve 215 and upper sliding sleeve 208 downwards. The upper sliding sleeve 208 moves sufficiently downwards to fully uncover the flapper valve 206 such that the flapper valve 206 freely rotates to the closed position. In one embodiment, the flapper valve 206 rotates out of the recess 207 to sealingly engage a flapper seat 402, as shown in FIG. 8. In one embodiment, the ball 202*e* continues moving downwards until the ball 202*e* lands on the seat formed by the upper ball bearings 226*a*. In the closed position, the flapper valve 206 blocks fluid communication through the bore 214 of the tubular 203. With the flapper valve 206 blocking the bore 214, fluid may no longer be injected into the formation 102 via the port 114.

Figure 9:
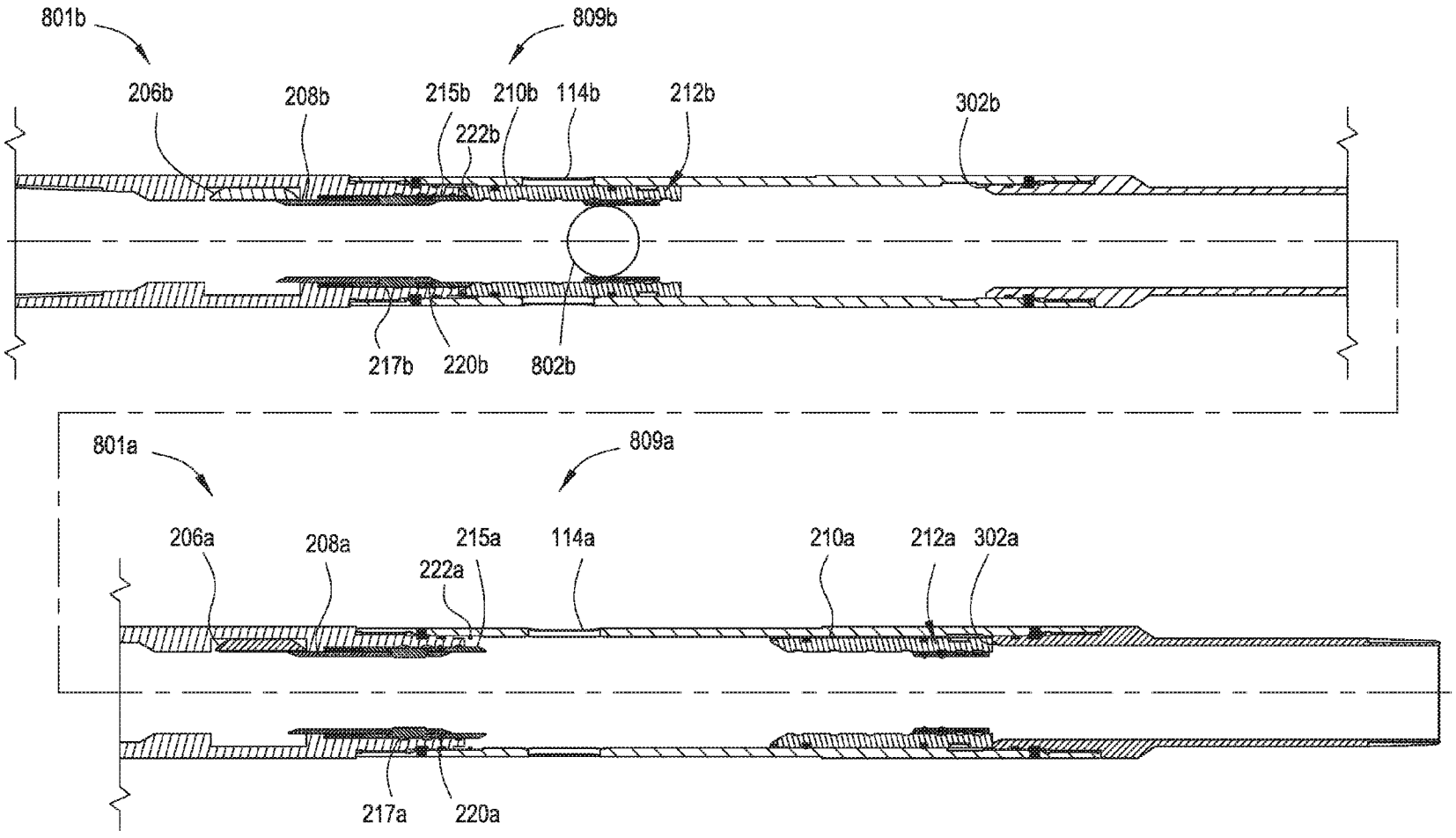
FIG. 9 illustrates an uphole and downhole isolation tool in operation.

A stimulation tool having a plurality of isolation tools may be used in the injection operation. For example, first and second isolation tools 809*a*, 809*b* are disposed in respective zones 801*a*, 801*b*, as shown in FIG. 9. The isolation tools 809*a*, 809*b* and the zones 801*a*, 801*b* may be located at any depth in the tubular 104. For example, any appropriate number of isolation tools 809 may be located above or below the isolation tools 809*a*, 809*b*. For convenience, the components on the isolation tools 809*a*, 809*b* that are similar to the components on the isolation tool 209 are labeled with the same reference indicator and a letter, such as an "a" or "b", indicating components further downhole or uphole, respectively. For example, isolation tool 809*b* is located uphole from isolation tool 809*a*. The counting mechanism 212 in each isolation tool 809 is configured such that each counting mechanism 212 is on a count preceding the count in the isolation tool immediately below (downhole) the respective isolation tool 809. For example, the counting mechanism 212*b* is on a second count when the counting mechanism 212*a* is on a third count. The counting mechanism 212 in each isolation tool 809 is also configured such that each counting mechanism 212 is in the actuating position when the lower sliding sleeve 210 immediately below the respective isolation tool 809 moves into the open position. For example, the counting mechanism 212*b* in the isolation tool 809*b* is in the actuating position when the lower sliding sleeve 210*a* in the isolation tool 809*a* is in the open position.

In operation, a ball 802*a* is released into the tubular 104, as with ball 202*a* in FIG. 2. In one embodiment, the ball 802*a* is released after opening circulation at a toe of the tubular 104. As the ball 802*a* travels downhole, the ball 802*a* may pass through multiple tools in the tubular 104. In one embodiment, the ball 802*a* passes through multiple isolation tools 809, each having a counting mechanism 212 configured to count an appropriate number of balls 802 before moving the lower sliding sleeve 210 to the open position. The ball 802*a* lands in the counting mechanism 212*b*, which is on a third and final count. The counting mechanism 212*b* completes the third count, thereby moving downward and releasing the ball 802*a*. In turn, the counting mechanism 212*b* is in the actuating position. The ball 802*a* continues traveling downwards and lands in the counting mechanism 212*a*, which is in the actuating position. The ball 802*a* causes the counting mechanism 212*a* to move downwards, thereby shearing the shear ring 222*a* and actuating the lower sliding sleeve 210*a* into the open position, as shown in FIG. 9. After actuating the lower sliding sleeve 210*a*, the ball 802*a* is released from the counting mechanism 212*a* and continues traveling downhole to provide a pressure buildup in the tubular 104. In one embodiment, the ball 802*a* continues downhole and actuates a flapper valve 206 in an isolation tool 809 below the isolation tool 809*a*. In another embodiment, the ball 802*a* continues downhole and sealingly plugs a single-shot valve below the isolation tool 809*a*. In yet another embodiment, the ball 802*a* continues downhole and closes a flapper valve below isolation tool 809*a*. Thereafter, fluid may be injected through port 114*a*.

Figure 10:
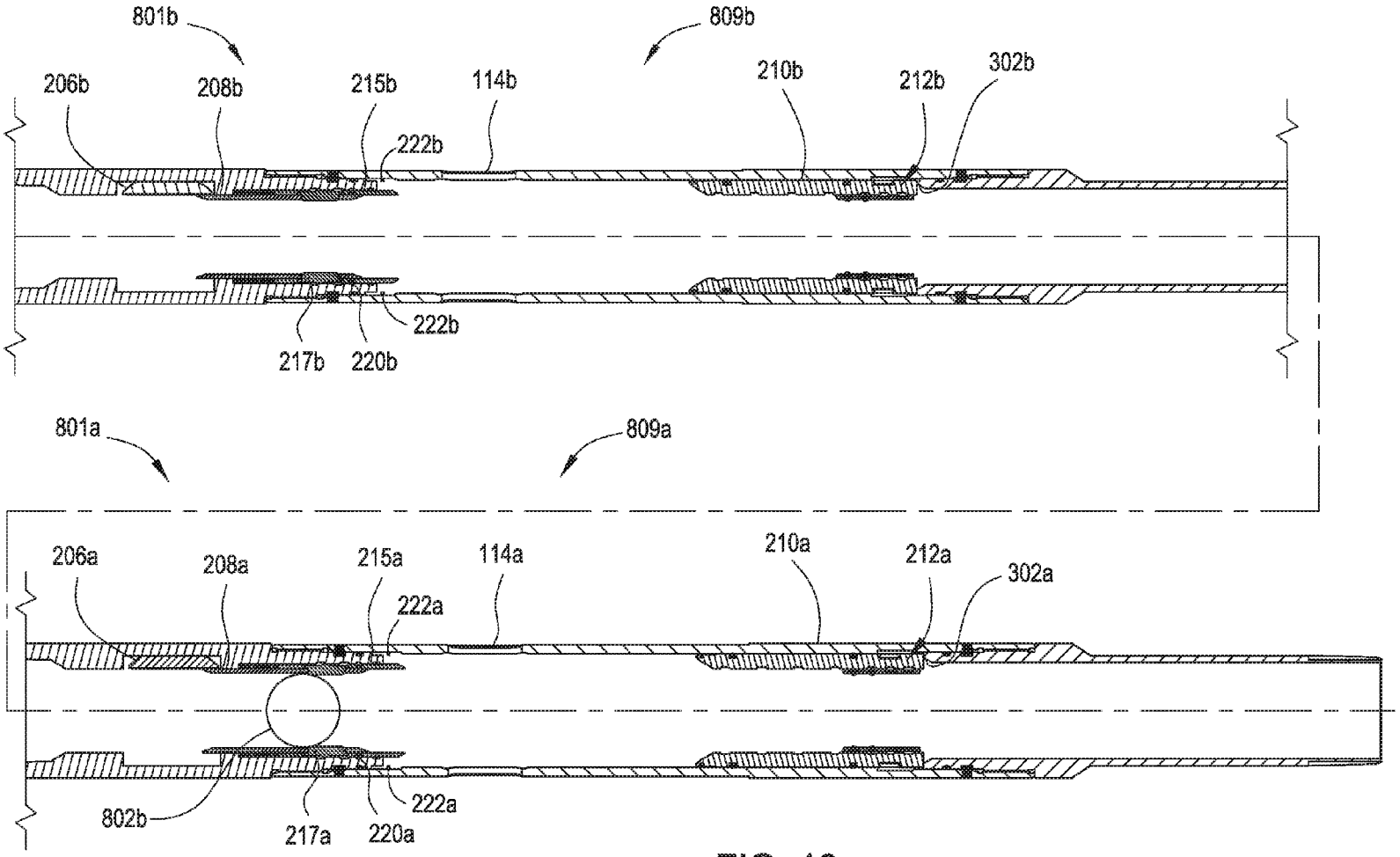
FIG. 10 illustrates the uphole and downhole isolation tool of FIG. 8 in operation.
Figure 11:
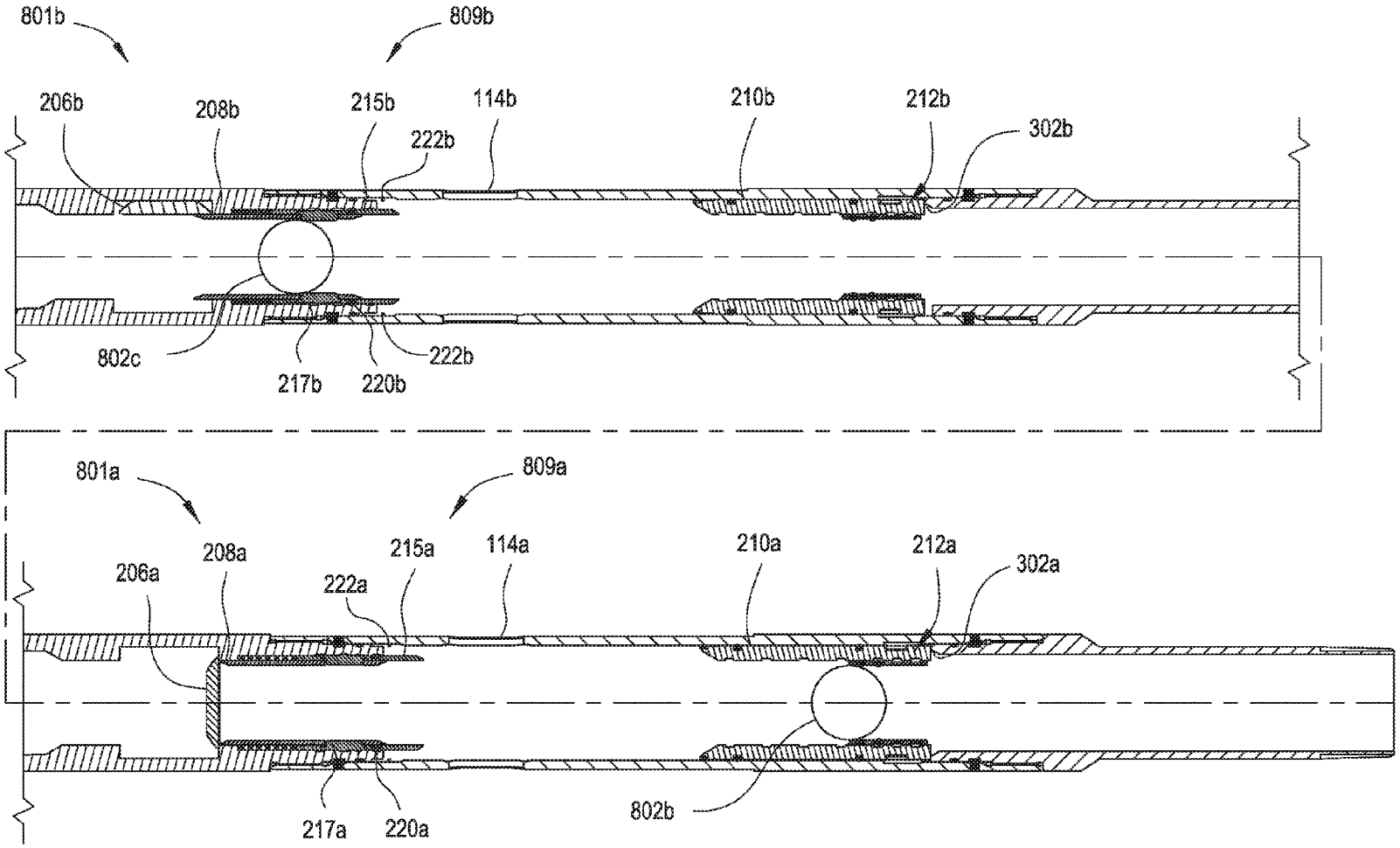
FIG. 11 illustrates the uphole and downhole isolation tool of FIG. 8 in operation.

After the injection operation through port 114*a* has concluded, a ball 802*b* is released into the tubular 104. The ball 802*b* may pass through multiple isolation tools 809 and land in the counting mechanism 212*b*, as shown in FIG. 9. The ball 802*b* causes the counting mechanism 212*b* to move downwards, thereby shearing the shear ring 222*b* and actuating the lower sliding sleeve 210*b* into the open position, as shown in FIG. 10. The counting mechanism 212*b* subsequently releases the ball 802*b* and the ball 802*b* continues downwards towards the isolation tool 809*a*. The ball 802*b* lands in the upper sliding sleeve 208*a* (FIG. 10) and moves the upper sleeve 208*a* downwards, thereby actuating the flapper valve 206*a* into the closed position (FIG. 11). In the closed position, the flapper valve 206*a* blocks fluid communication through the bore 214*a*. Thereafter, fluid may be injected into port 114*b*. Ball 802*b*, thereby, actuates both lower sliding sleeve 210*b* into the open position and flapper valve 206*a* into the closed position.

In one embodiment, after actuating the flapper valve 206*a*, the ball 802*b* is released from the upper sliding sleeve 208*a* and prevented from moving into another zone 801. For example, at one end of the zone 801*a*, the flapper 206*a* prevents the ball 802*b* from moving uphole. At an opposite end of the zone 801*a*, the seat formed by the counting mechanism 212*a* prevents the ball 802*b* from moving downhole.

After the injection operation through port 114*b* has concluded, a ball 802*c* is released into the tubular 104. The ball 802*c* may pass through multiple isolation tools 809 and land in the upper sliding sleeve 208*b*, as shown in FIG. 11. The ball 802*c* causes the upper sliding sleeve 208*b* to move downwards, thereby actuating the flapper valve 206*b* into the closed position. Thereafter, similar to the ball 802*b*, the ball 802*c* is prevented from moving into another zone 801.

The process of moving respective lower sliding sleeves 210, upper sliding sleeves 208, and flapper valves 206 may be repeated one or more times by releasing one or more subsequent balls 802 into the tubular 104 to engage one or more isolation tools 809 uphole. As such, multiple zones 801 may be sequentially isolated using balls 802 of the same size.

As will be understood by those skilled in the art, a number of variations and combinations may be made in relation to the disclosed embodiments all without departing from the scope of the invention.

In one embodiment, a stimulation tool includes a tubular having a port; a first sleeve member disposed in the tubular and actuatable by an actuating member to move from a closed position wherein fluid communication between a bore of the tubular and the port is blocked; and a closure member disposed in the tubular and actuatable by the actuating member to a closed position wherein fluid communication through the bore of the tubular is blocked.

In one or more of the embodiments described herein, the actuating member is a ball.

In one or more of the embodiments described herein, the closure member is a flapper valve.

In one or more of the embodiments described herein, the first sleeve member includes a first seat configured to receive and release the actuating member, the tool further comprising a second sleeve member disposed in the tubular, the second sleeve member includes a second seat configured to receive the actuating member, and the closure member is actuatable by the second sleeve member when the second seat receives the actuating member.

In one or more of the embodiments described herein, the first seat is configured to receive and release a second actuating member, and the second seat is configured to receive and release the second actuating member.

In one or more of the embodiments described herein, the closure member is downhole from the port.

In one or more of the embodiments described herein, the first seat is configured to receive a third actuating member, the tool further comprising a second closure member disposed in the tubular and actuatable by the third actuating member to a closed position wherein fluid communication through the bore of the tubular is blocked, the second closure member is actuatable by the first sleeve member when the first seat receives the third actuating member.

In one or more of the embodiments described herein, the tool also includes a biasing member disposed in the tubular and configured to bias the second sleeve member away from the closure member.

In one or more of the embodiments described herein, the second sleeve member includes engagement members.

In one or more of the embodiments described herein, the engagement members include dogs that form the second seat.

In one or more of the embodiments described herein, the engagement members are at least one of ball bearings and dogs.

In one or more of the embodiments described herein, the second sleeve member includes locking members.

In one or more of the embodiments described herein, the locking members are at least one of lock rings and snap rings.

In one or more of the embodiments described herein, the first sleeve member blocks the port in the closed position.

In one or more of the embodiments described herein, the first sleeve member includes a counting mechanism.

In one or more of the embodiments described herein, the counting mechanism is slidable and includes alternating locking members.

In one or more of the embodiments described herein, the locking members are at least one of lock rings and snap rings.

In one or more of the embodiments described herein, the counting mechanism is slidable and includes alternating engagement members.

In one or more of the embodiments described herein, the engagement members are at least one of ball bearings and dogs.

In one or more of the embodiments described herein, the counting mechanism is slidable and includes alternating locking members and alternating engagement members.

In one or more of the embodiments described herein, the second sleeve member includes a counting mechanism.

In one or more of the embodiments described herein, the tubular has a second port, the tool also includes a third sleeve member disposed in the tubular, wherein the third sleeve member includes a third seat and is actuatable to move from a closed position wherein fluid communication between a bore of the tubular and the second port is blocked; a fourth sleeve member disposed in the tubular, wherein the fourth sleeve member includes a fourth seat; and a third closure member disposed in the tubular and actuatable by the fourth sleeve to a closed position wherein fluid communication through the bore of the tubular is blocked.

In one embodiment, a multi-zone stimulation assembly includes a tubular a tubular having a first port, a second port, and a bore therethrough; a first sleeve member having a first seat, the first sleeve member configured to selectively allow fluid communication through the first port; a third sleeve member having a third seat; and a closure member disposed between the first and second ports and actuatable by the third sleeve member to a closed position wherein fluid communication is blocked through the bore of the tubular.

In one or more of the embodiments described herein, the assembly also includes a second sleeve member having a second seat, the second sleeve member configured to selectively allow fluid communication through the second port.

In one or more of the embodiments described herein, the first seat and the second seat are the same size.

In one or more of the embodiments described herein, the first sleeve member and second sleeve members each include a counting mechanism.

In one or more of the embodiments described herein, the third sleeve member includes a counting mechanism.

In one or more of the embodiments described herein, the third sleeve member includes at least one engagement member movable into the bore of the tubular to form the third seat.

In one or more of the embodiments described herein, the third sleeve member is actuated by the second sleeve member.

In one embodiment, a method of stimulating multiple zones of a tubular in a wellbore includes moving a sleeve member in the tubular by receiving an actuating member in the sleeve member; releasing the actuating member from the sleeve member; and actuating a closure member by receiving the released actuating member in a seat.

In one or more of the embodiments described herein, the actuating member is a ball.

In one or more of the embodiments described herein, the closure member is a flapper valve.

In one or more of the embodiments described herein, the method also includes forming the seat.

In one or more of the embodiments described herein, forming the seat comprises releasing a second actuating member into the tubular.

In one or more of the embodiments described herein, the second actuating member is released into the tubular before the sleeve member receives the actuating member.

In one or more of the embodiments described herein, at least one dimension of the actuating member is equal to at least one dimension of the second actuating member.

In one or more of the embodiments described herein, the second actuating member passes through the sleeve member before the seat is formed.

In one or more of the embodiments described herein, forming the seat includes moving at least one engagement member into a bore of the tubular.

In one or more of the embodiments described herein, actuating the closure member blocks fluid communication through a bore of the tubular.

In one or more of the embodiments described herein, moving the sleeve member allows fluid communication between a bore of the tubular and a port in the tubular.

In one or more of the embodiments described herein, receiving the actuating member includes engaging the actuating member with a seat in the sleeve member.

In one or more of the embodiments described herein, the method also includes forming a second seat by moving the sleeve member.

In one or more of the embodiments described herein, the actuating member passes through the sleeve member before actuating the closure member.

In one or more of the embodiments described herein, a momentum of the actuating member moves the sleeve member.

In one or more of the embodiments described herein, the method also includes pumping fluid through the port.

In one embodiment, a stimulation tool includes a tubular having a port; a first sleeve member disposed in the tubular, wherein the first sleeve member includes a first seat; a second sleeve member disposed in the tubular, wherein the second sleeve member is actuatable to form a second seat and is movable from a closed position wherein fluid communication between a bore of the tubular and the port is blocked; and a closure member disposed in the tubular and actuatable by the first sleeve member to a closed position wherein fluid communication through the bore of the tubular is blocked.

In one or more of the embodiments described herein, the first sleeve member includes engagement members; the engagement members include at least one of ball bearings and dogs; the first sleeve member includes locking members; the locking members include at least one of lock rings and snap rings; and the first sleeve member includes a counting mechanism.

In one or more of the embodiments described herein, the second sleeve member includes a counting mechanism; the counting mechanism is slidable and includes at least one of alternating locking members and alternating engagement members; the locking members include at least one of lock rings and snap rings; the engagement members include at least one of ball bearings and dogs; and the engagement members form the second seat.

The invention claimed is:

1. A stimulation tool, comprising:

a tubular having a first port and a second port;

a first sleeve member disposed in the tubular and actuatable by a second actuating member to move from a closed position wherein fluid communication between a bore of the tubular and the first port is blocked;

a second sleeve member disposed in the tubular and actuatable by a first actuating member to move from a closed position wherein fluid communication between the bore of the tubular and the second port is blocked; and a first closure member disposed in the tubular and actuatable by the second actuating member to a closed position wherein fluid communication through the bore of the tubular is blocked, wherein the second sleeve member includes a second seat configured to receive the first actuating member, and the second sleeve member separates and moves downhole from first closure member when the second seat receives the first actuating member.

2. The tool of claim 1, wherein the second actuating member is a ball.

3. The tool of claim 1, wherein the first closure member is a flapper valve.

4. The tool of claim 1, wherein:

the first sleeve member includes a first seat, the tool further comprising a third sleeve member disposed in the tubular, the third sleeve member includes a third seat configured to receive the second actuating member, and the first closure member is actuatable by the third sleeve member when the third seat receives the second actuating member.

5. The tool of claim 4, wherein the first seat is configured to receive and release the second actuating member, and the third seat is configured to receive and release the second actuating member.

6. The tool of claim 1, wherein the first closure member is downhole from the first port.

7. The tool of claim 4, wherein the first seat is configured to receive a third actuating member, the tool further comprising:

a second closure member disposed in the tubular and actuatable by the third actuating member to a closed position wherein fluid communication through the bore of the tubular is blocked, and a fourth sleeve member disposed in the tubular, the fourth sleeve member including a fourth seat configured to receive the third actuating member, and the second closure member is actuatable by the fourth sleeve member when the fourth seat receives the third actuating member.

8. The tool of claim 1, wherein the first sleeve member includes a counting mechanism that is slidable and includes alternating locking members and alternating engagement members.

9. A multi-zone stimulation assembly, comprising:

a tubular having a first port, a second port, and a bore therethrough;

a first sleeve member having a first seat, the first sleeve member configured to selectively allow fluid communication through the first port;

a second sleeve member having a second seat, the second sleeve member configured to selectively allow fluid communication through the second port a third sleeve member having a third seat, wherein the third sleeve member is actuated by the second sleeve member; and a closure member disposed between the first and second ports and actuatable by the third sleeve member to a closed position wherein fluid communication is blocked through the bore of the tubular.

10. A method of stimulating multiple zones of a tubular in a wellbore, comprising:

moving a sleeve member in the tubular by receiving an actuating member in the sleeve member, thereby allowing fluid communication between a bore of the tubular and a port uphole from the sleeve member in the tubular;

releasing the actuating member from the sleeve member;

after releasing the actuating member from the sleeve member, actuating a closure member by receiving the released actuating member in a seat, thereby blocking fluid communication through the bore of the tubular; and pumping fluid through the port.

11. The method of claim 10, wherein the actuating member is a ball.

12. The method of claim 10, wherein the closure member is a flapper valve.

13. The method of claim 10, further comprising forming the seat, wherein:

forming the seat comprises releasing a second actuating member into the tubular, and the second actuating member is released into the tubular before the sleeve member receives the actuating member.

14. The method of claim 13, wherein forming the seat includes moving at least one engagement member into the bore of the tubular.

15. The method of claim 10, wherein receiving the actuating member in the sleeve member includes engaging the actuating member with a second seat in the sleeve member.

16. The method of claim 10, wherein the actuating member passes through the sleeve member before actuating the closure member.

17. The method of claim 10, wherein a momentum of the actuating member moves the sleeve member.

18. A stimulation tool, comprising:

a tubular having a port;

a first sleeve member disposed in the tubular, wherein the first sleeve member includes a first seat, wherein the first seat is downhole from the port;

a second sleeve member disposed in the tubular, wherein the second sleeve member is actuatable to form a second seat and is movable from a closed position wherein fluid communication between a bore of the tubular and the port is blocked, wherein the second seat is downhole from the port, and the first seat is downhole from the second seat; and a closure member disposed in the tubular and actuatable by the first sleeve member to a closed position wherein fluid communication through the bore of the tubular is blocked, wherein the first seat is downhole from the closure member, and the closure member is downhole from the second seat.

19. The tool of claim 18, wherein:

the first sleeve member includes engagement members;

the engagement members include at least one of ball bearings and dogs;

the first sleeve member includes locking members;

the locking members include at least one of lock rings and snap rings; and the first sleeve member includes a counting mechanism.

20. The tool of claim 18, wherein:

the second sleeve member includes a counting mechanism;

the counting mechanism is slidable and includes at least one of alternating locking members and alternating engagement members;

the locking members include at least one of lock rings and snap rings;

the engagement members include at least one of ball bearings and dogs; and the engagement members form the second seat.

* * * * *